United States Patent [19]

Langloy

[11] Patent Number: 4,938,517

[45] Date of Patent: Jul. 3, 1990

[54] CLAMP FOR HANDLING AND LIFTING SHEET-METAL, PLATES OR THE LIKE

[76] Inventor: Charles Langloy, 24, rue Claude Farrere, Lyon 3 eme, Rhone, France

[21] Appl. No.: 268,814

[22] Filed: Nov. 8, 1988

[51] Int. Cl.[5] ..... B66C 1/48

[52] U.S. Cl. ..... 294/101; 294/104

[58] Field of Search ..... 294/101, 104, 82.33, 294/110.1

[56] References Cited

U.S. PATENT DOCUMENTS

| | | | |
|---|---|---|---|
| 1,011,660 | 12/1911 | Strathern | 294/101 X |
| 4,162,804 | 7/1979 | Davies | 294/101 |
| 4,327,944 | 5/1982 | Langloy | 294/101 |
| 4,702,508 | 10/1987 | Weiner et al. | 294/101 |

FOREIGN PATENT DOCUMENTS

| | | | |
|---|---|---|---|
| 7315265 | 11/1973 | Netherlands | 294/101 |
| 1397399 | 5/1988 | U.S.S.R. | 294/101 |
| 2177673 | 1/1987 | United Kingdom | 294/101 |

*Primary Examiner*—Margaret A. Focarino
*Assistant Examiner*—Joseph D. Pape
*Attorney, Agent, or Firm*—Herbert Dubno

[57] ABSTRACT

A clamp of the type comprising a body which, equipped with a gripper has a clevis-shaped part consisting, on the one hand, of a fixed jaw and, on the other hand, of a mobile jaw in the shape of a pivoting cam subjected to the action of a spring, the mobile jaw being releasable from its open position by a trigger pivotably mounted on the body and protruding inside the clevis. This clamp comprises a locking hook for locking the mobile jaw in the open position, independently of the trigger and actuatable by the latter during its pivoting motion in a direction of disengagement of the opening of the clevis, under the pressure of a sheet or the like.

5 Claims, 2 Drawing Sheets

CLAMP FOR HANDLING AND LIFTING SHEET-METAL, PLATES OR THE LIKE

FIELD OF THE INVENTION

My present invention relates to a clamp for handling and lifting sheet-metal sheets, plates or the like.

BACKGROUND OF THE INVENTION

The use of clamps for the handling of metal sheets, of plates made of other materials and similar pieces of reduced thickness, is known, these clamps comprising a clevis-shaped body equipped with means for attaching to a handling apparatus, such as a travelling crane, the clevis having one fixed arm and one pivotable arm shaped as a cam, actuated by a return spring in a mechanism shiftably past a dead point. The securing of the sheet inside the clamp is a result of a jamming effect of the two jaws of the clamp.

After the clamping of a sheet or the like, it is common to manually block the clamp in the locked position and to manually unlock the clamp, prior to opening it. Therefore, such clamps are very cumbersome in use.

It is also known to control the closing movement of the mobile jaw by means of a trigger arranged across the opening of the clevis and which is actuated by one edge of the sheet, when the jaw engages thereon. This pivoting trigger normally maintains the mobile jaw in an open position, which means in the ready-to-act position of the clamp.

When the clamp is brought into contact with the metal sheet, the pressure of the metal sheet against the trigger causes the latter to pivot, releasing the mobile jaw, which comes to rest against the sheet, by pivoting under the action of a spring. As a result, because of the shape of the cam constituting the mobile jaw, a self-locking of the sheet is produced when a traction is exerted upon the clamp. This technique is interesting, since it makes possible the automatic closing of the clamp when it comes in contact with the piece to be seized.

In order to open such a clamp, it suffices to actuate a lever associated with the mobile jaw, returning it to the open position, a position in which it normally has to be held by the trigger. However, when the opening of the clamp is effected by the pressure of the sheet against the trigger, the latter cannot maintain the pivoting jaw in the open position.

It is thus convenient simultaneously to effect the opening of the clamp and its disengagement from the sheet, in order to allow the trigger to fulfill its part as a locking member in keeping the mobile jaw in the open position. Such an operation is cumbersome to the user and requires great skill.

OBJECT OF THE INVENTION

It is the object of the present invention to find a remedy for these inconveniences.

SUMMARY OF THE INVENTION

For this purpose, the clamp comprises a body shaped like a clevis, having two receiving the sheet to be lifted between them, one of the arms consists of a fixed jaw, and cooperates with a mobile jaw shaped like a pivoting cam subjected to the action of a spring, the mobile jaw being releasable from its open position by a trigger pivotably mounted on the body and protruding inside the crotch of the clevis. The clamp has locking means for keeping the mobile jaw in open position, which are independent of the trigger and actuatable by the latter when it is pivoted in the direction of the release of the jaw from the open position, by the pressure of a sheet or the like.

In practice, the clamp being in the position ready for engagement, in order to insure the grip of the clamp on the sheet, it suffices to engage the clevis on the sheet to the point where the sheet rests against the trigger, which releases the locking means and allows the pivoting of the mobile jaw towards its closed position. In order to bring about the opening of the clamp, after the sheet has been positioned, it is enough to actuate the mobile jaw towards its open position, with the help of a lever associated therewith; it will remain blocked in this position by the locking means even if the sheet is still pressing against the trigger.

This way, it is possible to open the clamp without having to simultaneously disengage it from the sheet to be handled, as a result of the dissociation of the functions of the trigger and of the locking means of the mobile jaw.

According to one embodiment of this clamp, the locking means has a hook mounted on the body so as to be pivotable about a shaft (pivot) parallel to the pivots of the mobile jaw and the trigger, kept in locking position by the action of a spring and acting directly upon the mobile jaw or another piece connected operatively thereto. The hook has a boss on its face oriented towards the trigger, on which boss the free end of the trigger will come to engage during its pivoting motion. This engagement causes the pivoting of the hook in the release direction of the mobile jaw, when the trigger swings upwardly, i.e. is pressed out of the central opening of the clevis.

For this purpose the free end of the trigger carries a pawl swingables around an axis which is parallel to the axis of the latter, retractable against the action of a spring when it rests against the locking hook, during the downwardly pivoting motion of the trigger, i.e. in the closing direction of movement into the central portion of the clevis.

When the trigger pivots upwardly, under the action of a sheet to be handled, the pawl engages the boss of the hook and causes the latter to pivot, which frees the mobile jaw, the latter being this way capable to pivot towards its closed position.

When the mobile jaw is opened, it is maintained in the ready position by the hook. When the released sheet ceases to exert pressure on the trigger, the latter swings upwardly under the action of the spring it is associated with, the pawl assigned to the trigger retracting on contact with the hook, without changing the position of the latter, which means without unlocking the mobile jaw.

An embodiments of this clamp has a swing bar pivoted on the body about an axis which is parallel to the axis of the mobile jaw. At one end of the swing bar at least one connecting rod is articulated whose other end is linked to the mobile jaw. The other end of the swing bar serves for the affixing of a suspension chain, this end being equipped with a finger designed to co-operate with the nose-shaped end of the locking hook, in order to insure that the clamp is kept in the ready position.

BRIEF DESCRIPTION OF THE DRAWING

The above and other objects, features and advantages of my invention will become more readily apparent from the following description, reference being made to the accompanying highly diagrammatic drawing in which:

FIG. 1 illustrates a clamp 2, especially for handling sheet-metal and other flat-shaped pieces, comprising a body consisting of two parallel side plates, assembled by bolting, of which only the lower one 3 is shown in the drawing.

Figure 1:
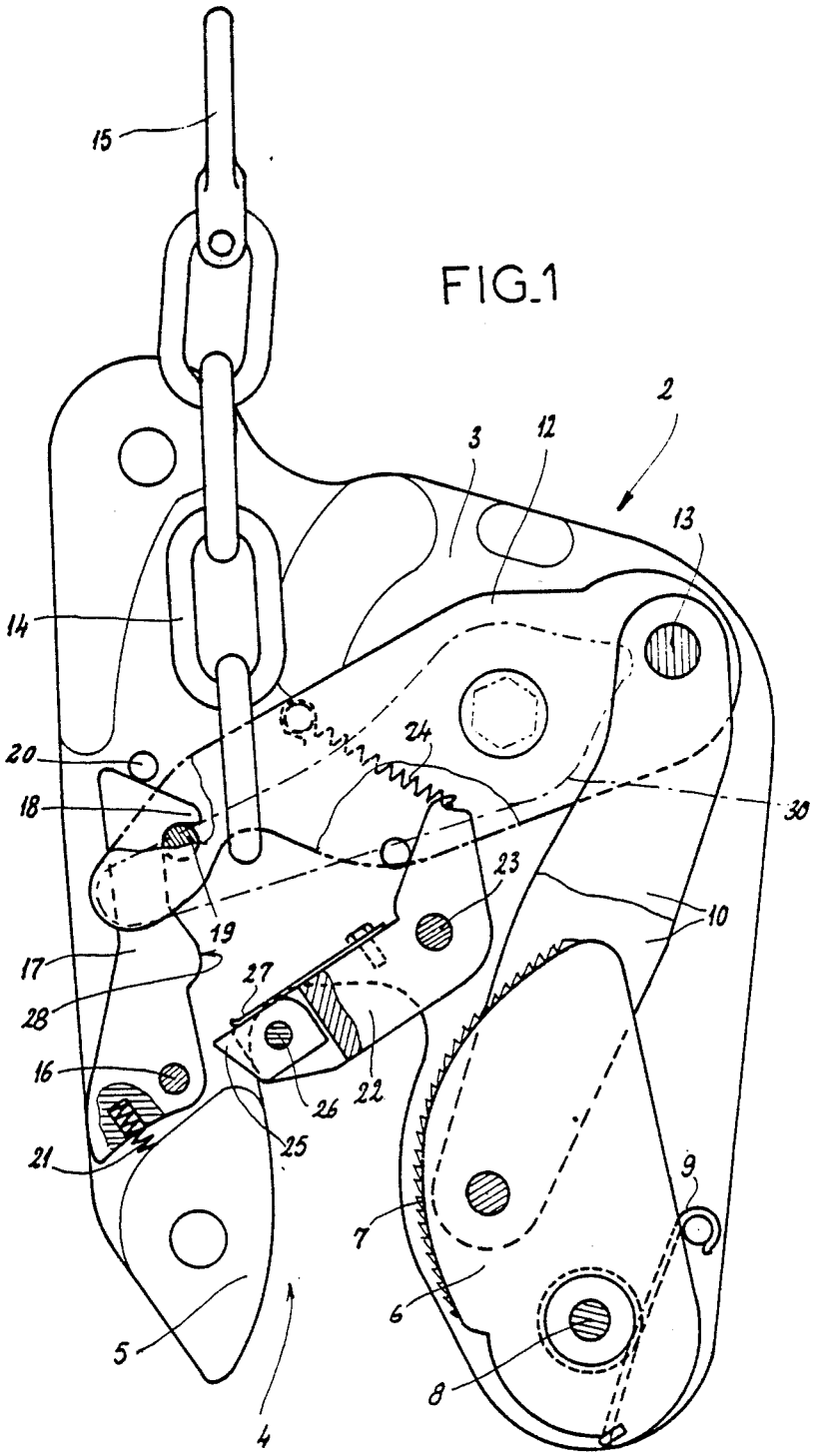
FIG. 1 is an elevational view of a clamp according to the invention in the braced position, the upper side plate being removed and parts broken away.

This clamp 2 is so designed that it has a body 4 shaped like a clevis, whose one arm is a fixed jaw 5 which is an integral part of the clamp body and the other arm is a pivotable jaw 6, consisting of a piece having a cam-shaped surface 7, this jaw 6 being swingable around an axis defined by a pivot 8 and subjected to the action of a spring 9, which tends to cause its pivoting towards its closed position (counter clockwise in FIG. 1).

In a known manner, the profile 7 of the jaw 6 has a configuration which insures the self-locking of a sheet, after the sheet has been introduced between the jaws 5 and 6.

On the mobile jaws 6, the ends of two parallel connecting rods 10 are hinged, their other two ends being articulated to a part 12, shaped like a swing bar, which is itself mounted on the clamp body to pivot about an axis defined by the pivot 13. Close to the other end of the swing bar 12, a chain 14 is attached. The other extremity of the chain is provided with a hook 15, for affixing to a travelling crane or the like. When traction is exerted upon the chain 14 during the handling of a sheet, the resultant of the forces transmitted by the swing bar 12 and the connecting rods 10 will favor the locking of the mobile jaw 6.

Equally pivotally connected to the body of the clamp to swing about an axis defined by pin 16, is a hook 17, having a nose 18 at its end opposite to the axis, this nose being designed to engage the finger 19 which is an integral part of the swing bar 12, in order to keep the latter in a position wherein the mobile jaw is open. This hook 17 is subjected to the action of a spring 21, pushing it towards its closing position, wherein it comes to rest against a stop 20.

This clamp is also equipped with a part 22 shaped like a trigger mounted to pivot around an axis defined by a pin 23, which is parallel to the axis of the other earlier-defined parts, this trigger 22 being subject to the action of a spring 24 in such a way as to project into the opening of the clevis 4, when no action is exerted upon it.

On its free end, this trigger 22 is provided with pawl 25, mounted the pivot around an axis defined by a pin 26 and being capable to retract against the action of a spring 27, when the trigger pivots in a counterclockwise direction.

The length of the trigger is so selected that, during its pivoting motion, the pawl 25 constituting its end rests against a boss 28, provided on the hook 17.

Figure 2:
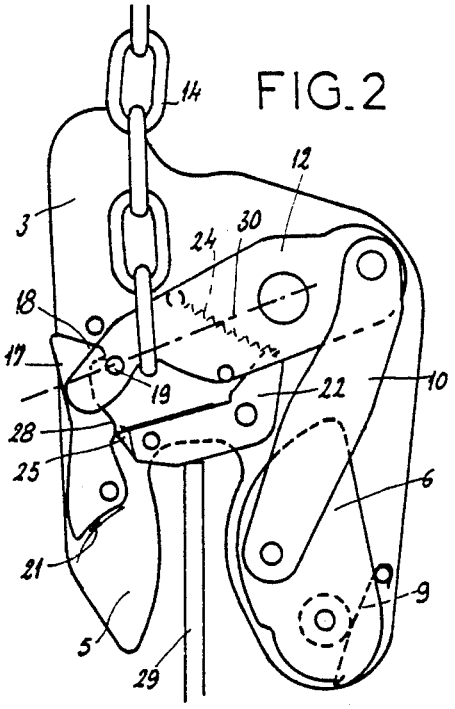
FIGS. 2 to 5 are four views, to a reduced scale, corresponding to FIG. 1, the clamp being respectively shown in the process of gripping a sheet (FIG. 2), during the handling of the sheet (FIG. 3), the clamp being closed at that time, during the unlocking of a sheet (FIG. 4), and during the retraction of the clamp with respect to the sheet which is about to be released (FIG. 5).
Figure 3:
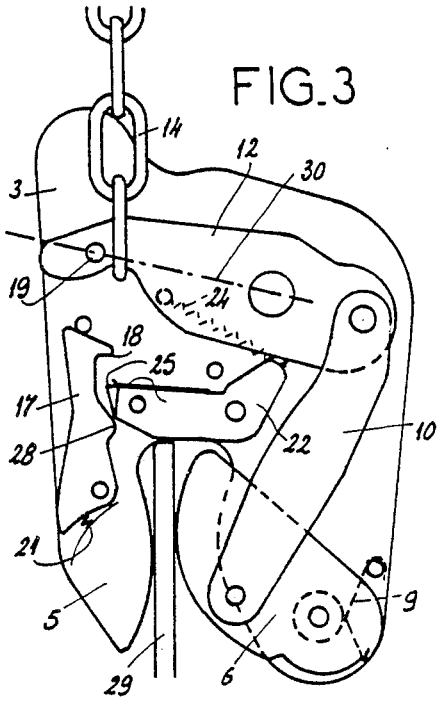
Figure 4:
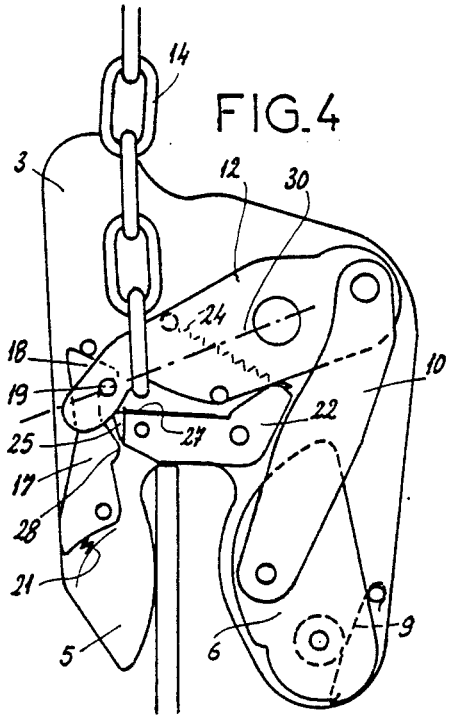

This clamp operates as follows:

Before gripping a sheet, the clamp is in the position shown in FIG. 1. It is then brought over the sheet 29 in such a way that the clevis-like opening of the clamp is touching the upper edge of the sheet. During this engagement, as shown in FIG. 2, the edge of the sheet comes to rest against the trigger, causing it to swing (clockwise) upwardly. During this motion the pawl 25 comes to rest against the boss 28 to swing the hook 17 in an opening direction (counterclockwise) releasing the swing bar 12 and, as a result, the mobile jaw 6, which pivots towards its closed position under the action of the spring 9 (counterclockwise). The clamp is then in the closed position shown in FIG. 3, a position in which the sheet can be handled.

Figure 5:
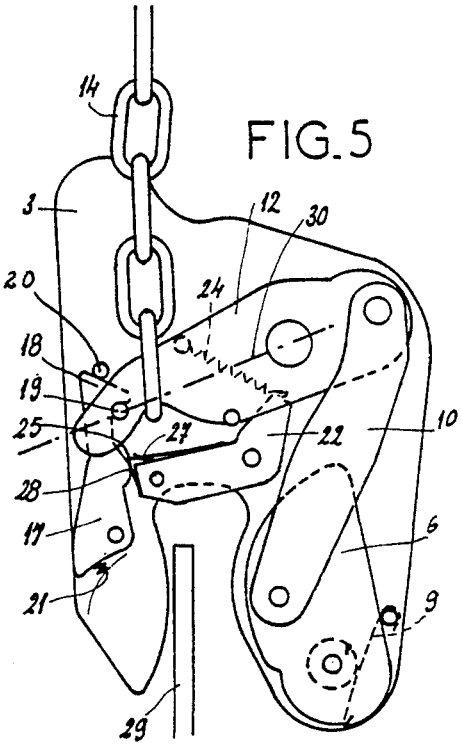

After the sheet 29 has been positioned in its place of use, the opening of the mobile jaw can be effected, by means of a lever 30, which is an integral part of the swing bar 12. During this motion, a pivoting of the swing bar 12 (counterclockwise), the connecting rods 10 and the mobile jaw 6 takes place (clockwise), these parts being held in the open position by the engagement of the nose 18 of the hook 17 behind the finger 19 of the swing bar 12. The clamp being in the open position, it suffices at this point to disengage it from the sheet, a motion during which, as shown in FIG. 5, the trigger returns to its initial position counterclockwise after the retraction of the pawl 25 during its passage into the contact with the boss 28 of the hook.

From the preceding description, it results that the clamp according to the invention, although it is based on a simple concept, is very practical and safe to use, namely by making possible the dissociation of the functions of bracing and disengaging of the mobile jaw.

It is self-understood that the invention is not limited the embodiment of the clamp described above as an example; on the contrary, the invention encompasses all the embodiment variants.

It is true especially that this clamp can also not be provided with the swing bar 12, the locking hook 17 acting in this case directly upon the mobile jaw 6, without leaving the framework of the invention.

I claim:

1. A clamp for handling a flat object, comprising:

a clevis-shaped body having two arms and an opening between said arms adapted to receive said object, one of said arms forming a fixed jaw on said body engageable with said object;

a mobile jaw carried by another of said arms and having a cam shape enabling said jaw to engage said object and be selftightening thereagainst;

means for pivotally connecting said mobile jaw to said other arm for swinging movement of said mobile jaw toward and away from said fixed jaw;

a spring on said other arm acting upon said mobile jaw for biasing said mobile jaw against said object;

a trigger pivotally mounted on said body and positioned to project into said opening for deflection by said object into a release position upon passage of said object into said opening;

means on said body for retaining said mobile jaw in an open position and operable by said trigger upon displacement of said trigger into said release position to release said mobile jaw to engage said object upon insertion of said object in said opening; and means for displacing said mobile jaw into said open position and thereafter retaining said mobile jaw in aid open position while said trigger is engaged by said object and held in said release position, thereby permitting withdrawal of said object from said opening.

2. A clamp for handling a flat object, comprising:

a clevis-shaped body having two arms and an opening between said arms adapted to receive said object, one of said arms forming a fixed jaw on said body engageable with said object;

a mobile jaw carried by another of said arms and having a cam shape enabling said jaw to engage said object and be selftightening thereagainst;

means for pivotally connecting said mobile jaw to said other arm for swinging movement of said mobile jaw toward and away from said fixed jaw;

a spring on said other arm acting upon said mobile jaw for biasing said mobile jaw against said object;

a trigger pivotally mounted on said body and positioned to project into said opening for deflection by said object into a release position upon passage of said object into said opening; and means on said body for retaining said mobile jaw in an open position and operable by said trigger upon displacement of said trigger into said release position to release said mobile jaw to engage said object upon insertion of said object in said opening, said means for retaining including:

a hook mounted on said body to pivot about an axis parallel to pivot axes of said jaw and said trigger, a further spring biasing said hook into a position operatively retaining said mobile jaw in said open position, and a boss formed on a face of said hook turned toward said trigger and engageable by said trigger upon movement of said trigger into said release position to release said mobile jaw, said mobile jaw being displaceable into said open position and thereafter being retained by said hook in said open position while said trigger is engaged by said object and held in said release position, thereby permitting withdrawal of said object from said opening.

3. The clamp defined in claim 2 wherein said trigger is provided with a free end, said trigger further comprising:

a pawl pivotally connected to said free end of said trigger for swinging movement about an axis parallel to said pivot axes, and a pawl spring on said trigger biasing said pawl into a rest position relative to said trigger, whereby said pawl is retractable on said trigger against said pawl spring upon movement of said trigger in a direction opposite a direction of movement into said release position when said trigger engages said hook.

4. The clamp defined in claim 3, further comprising:

a swing bar pivotally mounted on said body for rotation about an axis parallel to said pivot axes, said swing bar having a pair of opposite ends, a connecting rod articulated to one of said ends of said swing bar at one end of said connecting rod, another end of said connecting rod being pivotally connected to said mobile jaw, a suspension chain for said clamp connected to the other of said ends of said swing bar, and a finger formed in said other of said ends of said swing bar engageable by a nose-shaped end of said hook.

5. The clamp defined in claim 2, further comprising:

a swing bar pivotally mounted on said body for rotation about an axis parallel to said pivot axes, said swing bar having a pair of opposite ends, a connecting rod articulated to one of said ends of said swing bar at one end of said connecting rod, another end of said connecting rod being pivotally connected to said mobile jaw, a suspension chain for said clamp connected to the other of said ends of said swing bar, and a finger formed in said other of said ends of said swing bar engageable by a nose-shaped end of said hook.

* * * * *